United States Patent [19]

Sable

[11] 4,289,155

[45] Sep. 15, 1981

[54] APPARATUS FOR CLEANING A SWIMMING POOL

[75] Inventor: Chester A. Sable, Vista, Calif.

[73] Assignee: Anthony Pools, Div. of Anthony Indus., City of Commerce, Calif.

[21] Appl. No.: 145,589

[22] Filed: May 11, 1980

[51] Int. Cl.[3] ..... B08B 9/08; B08B 3/02

[52] U.S. Cl. ..... 134/167 R; 4/490; 15/1.7

[58] Field of Search ..... 4/490; 15/1.7; 134/167 R, 168 R

[56] References Cited

U.S. PATENT DOCUMENTS

| | | | |
|---|---|---|---|
| 3,261,371 | 7/1966 | Vernon | 134/168 R |
| 3,295,540 | 1/1967 | Ortega | 134/167 R |
| 3,521,304 | 7/1970 | Ghiz | 134/167 R X |
| 3,758,276 | 9/1973 | Bond et al. | 15/1.7 X |
| 4,023,581 | 5/1977 | Pansini et al. | 134/167 R |
| 4,089,074 | 5/1978 | Sermons | 4/490 X |

*Primary Examiner*—Robert L. Bleutge

*Attorney, Agent, or Firm*—George J. Netter

[57] ABSTRACT

A selectively adjustable buoyancy float for a pool cleaner is provided in order to suspend the cleaner below the upper surface of the water such that the pool cleaner can operate without being impeded by a pool cover.

5 Claims, 3 Drawing Figures

APPARATUS FOR CLEANING A SWIMMING POOL

The present invention relates generally to an apparatus for cleaning a swimming pool, and, more particularly, to such apparatus which can be operated when the pool includes a cover thereover.

BACKGROUND OF THE INVENTION

Apparatus for cleaning swimming pools in an automatic manner are well known in the art, an excellent example of which is that disclosed in U.S. Pat. No. 3,295,540, Pool Cleaning Apparatus by Robert Ortega. The apparatus of that patent includes wheel-like floats driven by pressurized water jets to move along the pool walls. Several trailing hoses are also connected to the pressurized water. Movement of water out the hose ends produces an undulating movement of the hoses that dislodges dirt, leaves and the like which may be adhering to the wall surfaces. The loosened materials become suspended in the water and are removed by the filter apparatus which is a customary part of the water conditioning apparatus for the pool. In the past, such apparatus has been maintained sufficiently buoyant that it would float on the top of the surface of the water and includes parts of the apparatus extending substantially above the water surface.

It has also been found that it is advisable to provide a cover over the swimming pool when the pool is not in use, both to aid in keeping dirt, dust and other waste materials from being thrown or otherwise deposited in the pool, as well as reducing the amount of heat needed to keep the pool at a given temperature. That is, during extended periods when a pool is not being used, covering the pool will maintain the pool at a higher temperature than would normally occur if it were left exposed to the air, thereby reducing the amount of energy needed to heat the pool. This is due to the fact that the cover prevents cooling air from directly contacting the pool water, and as well to the fact that heat being radiated away from the water will not be able to escape as readily into the surrounding air as would be the case with an uncovered pool.

Even though a pool is covered, it still needs cleaning since dirt and dust which has been deposited in the pool prior to the cover being placed thereover, must be removed in a timely manner to prevent it forming a tightly adherent layer on the pool plaster surface. However, known pool cleaners cannot operate effectively underneath a cover since the buoyant characteristics cause a substantial protrusion above the water level and these parts on contacting the pool cover stop movement and operation of the cleaner.

SUMMARY OF THE INVENTION

In the practice of this invention, there are provided means for selectively adjusting the buoyancy of a pool cleaner in order to suspend the cleaner below the upper surface of the water wherever in the pool the cleaner happens to be located. In this way, the pool cleaner can operate without being impeded by a pool cover.

DESCRIPTION OF A PREFERRED EMBODIMENT

Figure 1:
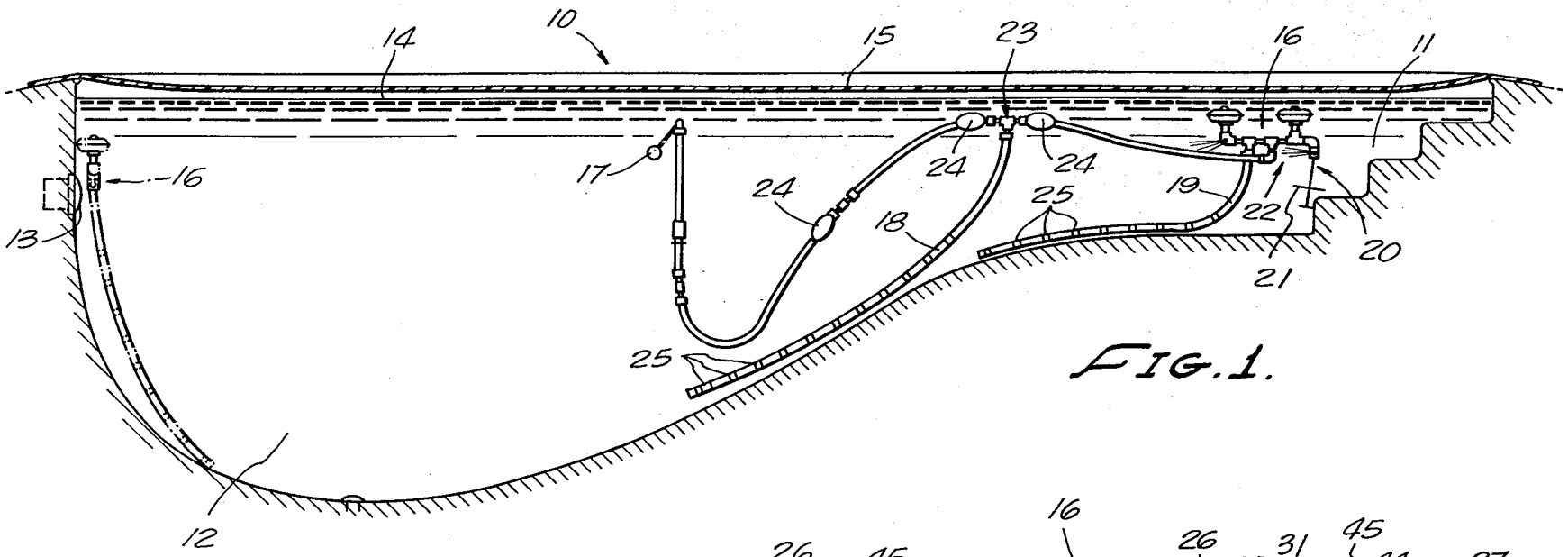
FIG. 1 is a side elevational sectional view of a typical swimming pool with cover and cleaning apparatus of this invention.

Turning now to the drawings, and particularly to FIG. 1, a typical swimming pool 10 is shown including a shallow end 11 where a set of steps are located and having a depth of approximately three feet. The bottom wall of the pool grades off to a deeper end 12 which will usually range from six to nine feet. Also, typically, at the deep end a light 13 is arranged in the end wall and located approximately eighteen inches (45.7 cm.) below the top surface 14 of the water. A pool cover 15 extends over the complete water surface and in slightly spaced relation thereto. A swimming pool cleaning apparatus enumerated generally as at 16, in a way that will be more particularly described, moves around the pool closely adjacent the side wall with a pair of hoses that direct pressurized water against the side walls and the floor of the pool, as well as frictionally engaging the same, sending dirt and other extraneous materials into suspension so that they may be picked up and removed by the filter apparatus of the pool. Also, as will be described herein, the cleaning apparatus 16 is floated below the surface of the pool water and is thereby maintained in a spaced relation from the cover 15 of the pool.

The pool cleaning apparatus 16 is powered by a jet pump (not shown) connected to the return line from the filter apparatus which is a normal part of the pool equipment, and sends high pressure water through a wall outlet 17 to hoses 18 and 19 of the cleaning apparatus. A so-called control head 20 includes a hydraulically driven wheel 21 which guides the entire cleaning apparatus around the perimeter of the pool by rolling against the side wall and is interconnected with a control arm assembly 22 including tubes, flats and jets to help guide the sweep around the pool and support the control head and wall cleaning hose. A floor hose support 23 includes several floats 24 to which the floor cleaning hose 18 is attached.

In operation, the high pressure water is emitted from small orifices in tubing parts of the control head 20 which act as jets to drive the apparatus around the pool. The pressurized water is also driven outwardly of the ends of the two hoses, namely, the floor hose 18 and the wall hose 19, and because of the flexibility of the hoses they will swish and undulate across the pool bottom and sides in a random pattern thereby frictionally removing any dirt or other materials which may be adhering to the wall surfaces.

A plurality of wear sleeves 25 are located at spaced intervals along the hoses 18 and 19 to reduce frictional wear of the hoses. These sleeves are free to rotate about the hose as an axis for the purpose of increasing sleeve life by exposing a greater area of sleeve contact with the pool wall surface and decreasing sliding friction to rolling friction. Contact of the sleeves with the pool wall surface also serves to aid in removing materials therefrom.

The control arm assembly 22 is also seen to include a pair of generally disklike float members 26 which are, in a way to be described, selectively modifiable as to buoyancy. Each float member includes a hollow, generally toroidal shaped cover 27 with a cylindrical tube 28 having an axially extending cylindrical bore 29 passing completely through the float member. The top surface 30 of float member is imperforate except for the opening of bore 29 and has a circular recess 31 for receiving a washer bearing 32.

A disKlike float 33 has an axial bore 34 enabling sliding receipt onto tube 28 of the cover. The peripheral walls of float 33 are beveled and include a plurality of uniformly dimensioned flutes or recesses 35 each of which can accommodate one ball float 36. Although other materials may be found useful, at the present time a preferred construction for the ball float is a hollow plastic sphere not unlike a ping-pong ball.

The control arm assembly 22 includes a plurality of hard plastic pipe sections 37 interconnected to incoming pressurized water via a T-section 38 and further includes an elbow 39 and T-section 40 onto which are mounted vertically extending, hard plastic shafts 41.

Figure 2:
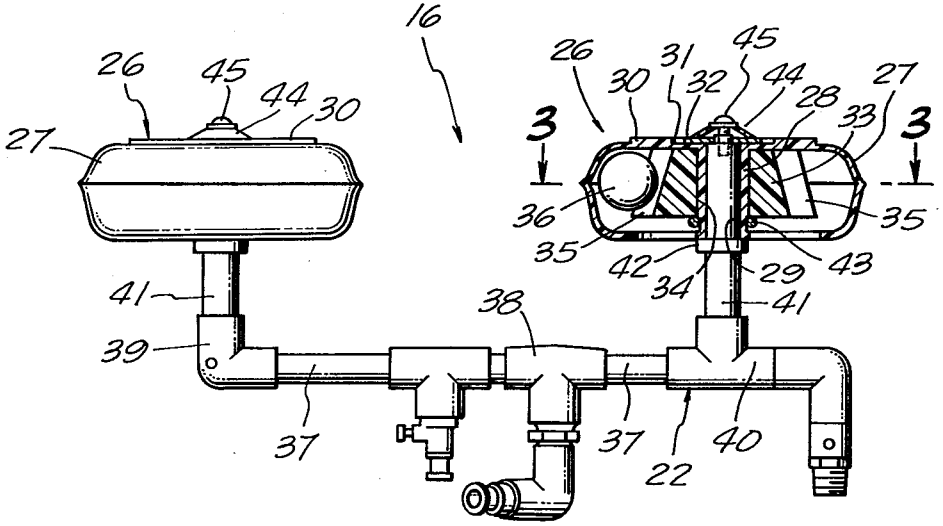
FIG. 2 is an enlarged partially sectional view of a portion of the pool cleaning apparatus of FIG. 1.
Figure 3:
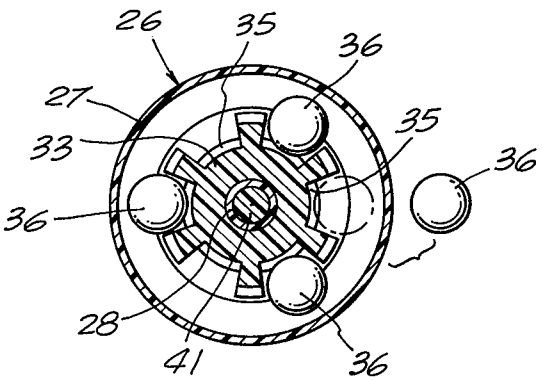
FIG. 3 is a top plan sectional view taken along the line 3—3 of FIG. 2.

With reference now particularly to FIG. 2, the ensuing description of assembly of the float members 26 will be given. A stop ring 42 is received on the shaft 41 and affixed thereto. A selected number of ball floats are inserted into the interior of the cover 27 and the bevel-sided float 33 is slid onto tube 28 with the smaller diameter side of float 33 facing the cover interior. The float 33 is manipulated until all of the ball floats 36 are individually located in separate flutes. Next, an O-ring 43 is positioned on the cylindrical tube 28 to hold the bevel-sided float 33, and ball floats 36 secured thereby, within the cover 27. Then, the cover, balls and float are placed as a unit on the shaft 41. Washer 32 is located over the shaft end and a finishing flange 44 and screw 45 secure the entire assembly together. The float member 33 is free to rotate on the tube 28 and the flute and interior cover dimensions are such as to retain the ball floats within the cover.

When the described pool cleaning apparatus is first installed several test runs may have to be made to determine the proper number ball floats 36 to use in each float member 26. For example, assume initially that three (3) such ball floats were included in float member 33. The apparatus should be then allowed to cycle completely around the pool several times to determine if it floats substantially entirely below the water surface and does not either hang up at some point, or extend above the water surface and obstructingly contact the pool cover. If it is found that there is too much buoyancy to the floats, then the members 33 must be disassembled and one (or more) of the ball floats removed, and after assembly the apparatus should be cycled several times about the pool to determine if it is operating properly.

It is also preferable that the apparatus not sink so far in the water as to contact the light 13 on moving therepast. It also must be kept in mind when the cleaning apparatus is in the shallow end of the pool more of the hoses 18 and 19 rest on the pool floor and, therefore, the members 26 will ride higher in the water. Conversely, when the apparatus is in the deep end of the pool almost the entire weight of the hoses will have to be supported by the floats and, accordingly, the apparatus will ride lower in the water.

I claim:

1. In apparatus for cleaning a swimming pool including a flexible conduit connected to a source of pressurized water, one or more hoses connected to said conduit, means powered by the pressurized water to drive the hoses about the pool, and float means for supporting the drive means, hoses and conduit in the water, the improvement comprising:

the float means includes a float member of selectively variable buoyancy that is adjusted to such buoyancy as to locate the hoses, drive means, conduit and float means below the upper surface of the pool water.

2. Apparatus as in claim 1, which the float member includes a hollow cover within which a selected number of individual floats are received.

3. Apparatus as in claim 2, in which said cover is generally toroidal shaped with an axially located tubular member having cylindrical bore and an annular chamber, a disklike float with a central bore for receipt onto the cover tubular member, said individual floats being secured by the disklike float within the cover annular chamber.

4. Apparatus as in claim 3, in which the disklike float has a fluted peripheral edge for receiving the individual floats therein.

5. Apparatus as in claim 1, in which said individual floats include hollow plastic spheres.

* * * * *